US006858987B2

(12) United States Patent
Hiramoto

(10) Patent No.: US 6,858,987 B2
(45) Date of Patent: Feb. 22, 2005

(54) FLASH LAMP UNIT AND FLASH RADIATION DEVICE

(75) Inventor: Tatumi Hiramoto, Tokyo (JP)

(73) Assignee: Ushio Denki Kabushiki Kaisya, Tokyo (JP)

( * ) Notice: Subject to any disclaimer, the term of this patent is extended or adjusted under 35 U.S.C. 154(b) by 0 days.

(21) Appl. No.: 10/442,254

(22) Filed: May 21, 2003

(65) Prior Publication Data

US 2003/0230981 A1 Dec. 18, 2003

(30) Foreign Application Priority Data

May 22, 2002 (JP) ..... 2002-148014

(51) Int. Cl.[7] ..... H05B 39/00; H01J 17/20

(52) U.S. Cl. ..... 315/105; 315/49; 315/46; 315/106; 313/639; 313/641; 313/637

(58) Field of Search ..... 315/105, 106, 315/49, 46, 56–58, 200 A, 185 S; 313/639, 640–642, 636–638, 627, 629

(56) References Cited

U.S. PATENT DOCUMENTS 5,051,649 A * 9/1991 Waymouth ..... 313/15
5,134,336 A * 7/1992 Chakrabarti et al. ..... 313/25
6,084,351 A * 7/2000 Kai et al. ..... 313/634

FOREIGN PATENT DOCUMENTS

JP 2001-68056 3/2001

* cited by examiner

*Primary Examiner*—Tuyet Thi Vo
(74) *Attorney, Agent, or Firm*—Oblon, Spivak, McClelland, Maier & Neustadt, P.C.

(57) ABSTRACT

The object of the present invention is to provide a flash lamp unit with a long service life which allows a high radiant efficiency to be obtained and a flash radiation device demonstrating excellent flash radiant performance despite a small size, and the flash lamp unit comprises a flash lamp having mercury sealed in a discharge container, wherein preheating means is provided for preheating the flash lamp, the quantity of contained mercury in the flash lamp is in the range of 0.2 to 55 mg/cm$^3$, and the flash lamp is ignited under the specified conditions, and the flash radiation device comprises the above-described flash lamp as a light source.

8 Claims, 10 Drawing Sheets

FLASH LAMP UNIT AND FLASH RADIATION DEVICE

BACKGROUND OF THE INVENTION

1. Field of the Invention

The present invention relates to a flash lamp unit and a flash radiation device.

2. Description of the Related Art

Flash radiation devices have been used for treatment such as optical heat treatment by which, for example, only part of the surface layer of the article to be treated is selectively heated for a short time at a high temperature by irradiating the article with a flash, and low-temperature UV irradiation treatment by which the surface of the article to be treated is irradiated with intensive UV radiation, almost without heating the article.

Laser radiation devices such as solid-state laser radiation devices, gas laser radiation devices and flash lamps in which a rare gas, for example, xenon, krypton, or the like is sealed in a discharge container made from quartz glass (sometimes referred to as "rare gas flash lamps hereinbelow") have been known as light sources for such flash radiation devices. However, because in the laser radiation devices, the flash is radiated at a single wavelength and the laser device for emitting photons per unit energy are very expensive, irradiation of the entire surface of the articles having a large treatment surface area is difficult. For this reason, rare gas flash lamps have been widely used.

However, in the rare gas flash lamps, a flash ignition state in which a flash is radiated within a short time is obtained by driving the lamp by supplying a flash power and also applying a high trigger voltage. However, in such flash lamps, the radiant efficiency representing the radiant quantity of flash related to the quantity of the supplied flash power is small. Moreover, the problem is that the radiant ratio of light (sometimes referred to hereinbelow as "long-wave UV light") in a long wavelength region (wavelength 200 to 400 nm), which is considered to be effective for low-temperature UV irradiation treatment for conducting photochemical reactions, is especially small in the radiated flash.

The possibility of using a large power source unit for supplying the flash power and increasing the quantity of flash power supplied to the rare gas flash lamps has been studied.

However, in the rare gas flash lamps in a flash ignition state, the emission ratio of long-wave UV light generated inside the discharge container is small, whereas the emission ratio of light generated in a short wavelength region (sometimes referred to hereinbelow as "short-wave UV light"), which is absorbed by the materials constituting the discharge container, is large. Therefore, the quantity of emitted long-wave UV light increases as the quantity of the supplied flash power increases, which necessarily results in the increased quantity of emitted short-wave UV light. As a result, the problem associated with the flash radiation devices with a large supplied quantity of flash power is that rapid degradation occurs due to the absorption of a large quantity of short-wave UV light by the discharge container of the rare gas flash lamp.

Therefore, in the flash radiation devices, a plurality of gas flash lamps ignited by a comparatively low power have been used in order to obtain the flash radiation performance necessary for the treatment. As a result, the size of the flash radiation devices was increased and the cost thereof was raised.

SUMMARY OF THE INVENTION

With the foregoing in view, it is an object of the present invention to provide a flash lamp unit with a long service life which makes it possible to obtain a high radiant efficiency.

Another object of the present invention is to provide a flash radiation device with excellent flash radiation performance, despite a small size.

The flash lamp unit in accordance with the present invention comprises a flash lamp having mercury sealed in a discharge container, wherein preheating means is provided for preheating the flash lamp, and the quantity of contained mercury in the flash lamp is in the range of 0.2 to 55 mg/cm$^3$, and the flash lamp is ignited under the conditions satisfying the Formula (1) presented below:

$$W_1=Q/(V\times\Delta t)\geqq 2.1\times10^4\times H^{0.25} \quad (1)$$

where $W_1$ is the average power density (W/cm$^3$) in the flash lamp, Q is the flash power quantity (J), V is the internal volume (cm$^3$) of the discharge container, $\Delta t$ is the half-power width (sec), and H is the quantity of contained mercury (mg/cm$^3$).

It is preferred that in the flash lamp unit in accordance with the present invention, the preheating with preheating means is conducted till the conditions are reached satisfying the Formula (2) presented below:

$$TW_1\geqq 5300/\{11.47-\ln(H)\} \quad (2)$$

where $Tw_1$ (K) is the temperature of the outer peripheral surface of the discharge container constituting the flash lamp.

The flash lamp unit in accordance with the present invention comprises a flash lamp having mercury sealed in a discharge container, wherein preheating means is provided for preheating the flash lamp, an alkali element comprising at least one of sodium, potassium, rubidium, and cesium is sealed inside the discharge container of the flash lamp in an amount such that the ratio of the mole number of the alkali element to the mole number of mercury is in the range of 0.1 to 20%, and the flash lamp is ignited under the conditions satisfying the Formula (3) presented below:

$$W_2=Q/(V\times\Delta t)\geqq 5\times10^3\times(\alpha/100\times S)^{0.25} \quad (3)$$

where $W_2$ is the average power density (W/cm$^3$) in the flash lamp, Q is the flash power quantity (J), V is the internal volume (cm$^3$) of the discharge container, $\Delta t$ is the half-power width (sec), $\alpha$ (%) is the ratio of the mole number of the alkali element to the mole number of mercury, and S is the ratio of the atomic weight of cesium to the average value of the atomic weight of alkali elements.

It is preferred that in the flash lamp unit in accordance with the present invention, the preheating with preheating means is conducted till the conditions are reached satisfying the Formula (4) presented below:

$$Tw_2 \geqq (6940 \times S^{0.208}) / \{8.73 \times S^{0.0755} - \ln(S \times A) \times (1-\alpha/100)^{0.5}\} \quad (4)$$

where $Tw_2$ (K) is the temperature of the outer peripheral surface of the discharge container constituting the flash lamp and A ($mg/cm^3$) is the quantity of the charged alkali element.

In the flash lamp unit in accordance with the present invention, the preheating with preheating means is conducted by heating the discharge container constituting the flash lamp from the outer peripheral surface of the discharge container, or by supplying to the flash lamp the average power for preheating having a value less than the average power during flashing.

In the flash lamp unit in accordance with the present invention, it is preferred that a rare gas composed of at least one of helium gas, neon gas, argon gas, krypton gas, and xenon gas be sealed inside the discharge container constituting the flash lamp in an amount such that it has a pressure of no more than $3 \times 10^5$ Pa at room temperature.

The flash radiation device in accordance with the present invention comprises the above-described flash lamp unit as a light source.

With the flash lamp unit in accordance with the present invention, controlling the average power density and the quantity of the specified sealed substance sealed in the flash lamp makes it possible to use at a high ratio the bremsstrahlung relating to the electrons derived from ionization of the sealed substance, thereby increasing the radiant ratio of long-wave UV light (light with a wavelength of 200 to 400 nm) or short-wave visible light (light with a wavelength of 400 to 600 nm) in the flash light emitted from the flash lamp. Moreover, because mercury is used as the main light-emitting substance, the emission ratio of short-wave UV light generated in the discharge container of the flash light in a flash ignition state is small. As a result, rapid degradation of flash lamps caused by the discharge container absorbing the short-wave UV radiation can be prevented.

Therefore, a high radiant efficiency and a long service life can be obtained in the flash lamp unit in accordance with the present invention.

DESCRIPTION OF THE PREFERRED EMBODIMENTS

The preferred embodiments of the present invention will be described hereinbelow in greater detail.

(First Preferred Embodiment)

Figure 1:
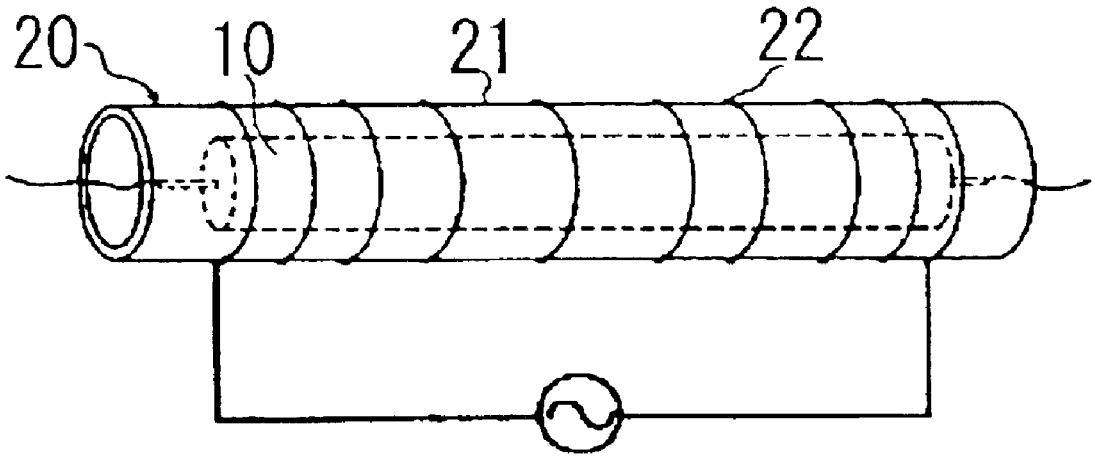
FIG. 1 is an explanatory drawing illustrating an embodiment of the flash lamp unit in accordance with the present invention.
Figure 2:
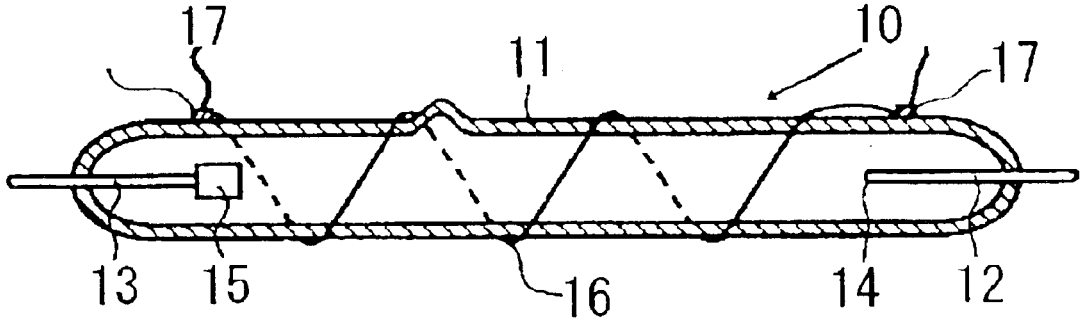
FIG. 2 is an explanatory drawing illustrating a flash lamp provided in the flash lamp unit in FIG. 1.

FIG. 1 is an explanatory view illustrating an embodiment of the flash lamp unit in accordance with the present invention. FIG. 2 is an explanatory view illustrating a flash lamp provided in the flash lamp unit shown in FIG. 1.

The flash lamp unit comprises a flash lamp 10 in which mercury as the main emission substance is sealed inside a discharge container 11 and preheating means 20 in which a wire-like heater 22, for example, from a nichrome wire, is wound around the outer peripheral surface of a cylindrical heating tube 21 provided so as to cover the flash lamp 10.

In this example, the heating tube 21 constituting preheating means 20 is a quartz glass tube having an outer diameter slightly larger than the outer diameter of the discharge container 11 constituting the flash lamp 10 and a total length larger than the total length of the discharger container 11, this tube having a structure in which the flash lamp 10 inserted into the heating tube 21 is fixedly held by support members (not shown in the figures).

The flash lamp 10 has a cylindrical shape sealed at both ends and comprises the discharge container 11 in the form of a straight tube enclosing the discharge space. An anode 14 and a cathode 15 formed on distal ends of respective electrode rods 12, 13 extending so as to protrude inward along the tube axis from both ends of the discharge container 11 are arranged opposite one another inside the discharge container 11.

Mercury sealed in the flash lamp 10 may be in the elemental form or as a compound. When a mercury compound is sealed, it is preferred that a compound be selected which has a vapor pressure equal to or higher than that of the elemental mercury at the same temperature.

The flash lamp 10 shown in FIG. 2 comprises a trigger electrode 16 disposed on the outer surface of discharge container 11 so as to extend spirally in the lamp axis direction. The trigger electrode 16 is supported by a band 17.

Figure 3:
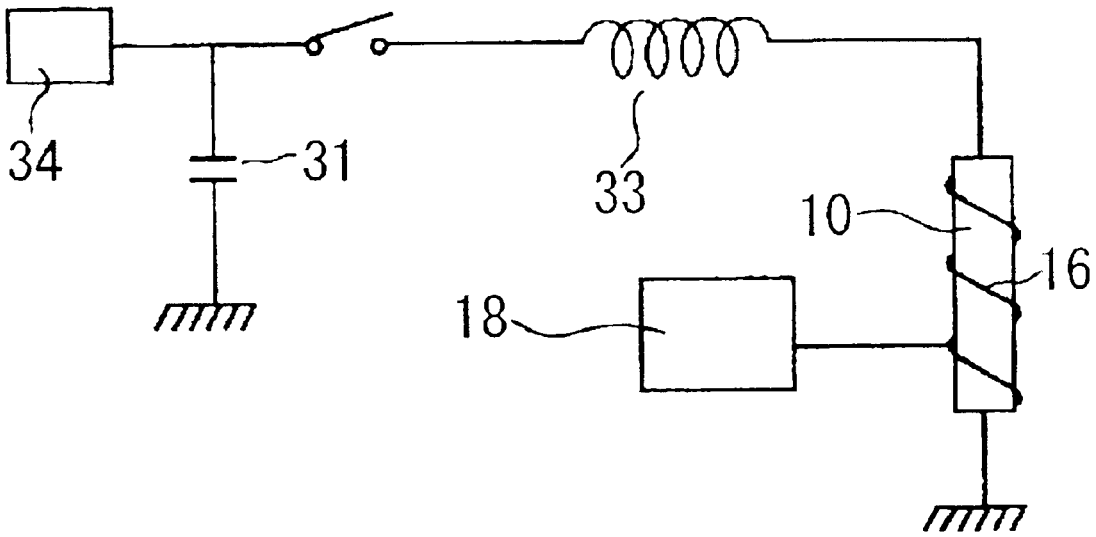
FIG. 3 is an explanatory drawing illustrating a specific example of an ignition circuit of the flash lamp shown in FIG. 2.

FIG. 3 is an explanatory drawing illustrating a specific example of an ignition circuit of the flash lamp shown in FIG. 2.

The flash lamp 10 is connected via a waveform shaping coil 33 to a main capacitor 31 for energy supply, and the trigger electrode 16 of the flash lamp 10 is connected to a trigger circuit 18.

In this example, the reference numeral 34 stands for a power source unit for supplying electric power to the main capacitor 31.

Examples of materials suitable for the discharge container 11 include materials having transparency, such as quartz glass, polycrystalline alumina, sapphire, and the like.

Further, no specific limitation is placed on the entire length, outer diameter, and inner diameter of the discharge container 11, and the discharge containers of a variety of shapes can be used according to the application of the flash lamp unit. Usually, the entire length is 1 to 50 cm, the outer diameter is 0.7 to 1.8 cm, and the inner diameter is 0.5 to 1.5 cm.

Mercury is sealed inside the discharge container 11. The quantity of contained mercury per unit inner volume of the discharge container 11 is in the range of 0.2 to 55 mg/cm$^3$.

When the quantity of contained mercury is less than 0.2 mg/cm$^3$, the sufficient electron density in the flash lamp in a flash ignition state cannot be obtained. Therefore, a high radiant efficiency cannot be obtained.

On the other hand, if the quantity of contained mercury exceeds 55 mg/cm$^3$, the internal pressure of the discharge container increases and the start voltage increases accordingly. In addition, the pressure during flash ignition rises, sufficient safety cannot be guaranteed, and the degree of freedom in designing the ignition circuit for the flash light is decreased.

In the flash lamp unit having the above-described configuration, a high trigger voltage generated in the trigger circuit 18 is applied to the trigger electrode 16 of the flash lamp 10 preheated to the prescribed temperature by preheating means 20, causing the breakdown of insulation. As a result, the energy of the quantity represented by formula (a) below, that has been accumulated at a charge voltage $V_o$ (V) in the main capacitor 31 with an electric capacitance C ($\mu$F) is supplied as a flash power quantity Q (J) to the flash lamp 10 via the waveform shaping coil 33. Therefore, the flash lamp 10 is activated and a flash ignition state is assumed in which the emitted light of a very high radiance can be obtained within a short time.

$$Q=C\times V_0/2 \qquad \text{Formula (a)}$$

[in this formula, Q is the flash power-quantity (J), C is the electric capacitance ($\mu$F) of the main capacitor, and $V_o$ is the charge voltage (V)].

The flash lamp 10 has to be flash ignited under conditions such that the aforesaid Formula (1) relating to the average power density is valid.

In Formula (1), "the average power density ($W_1$) in the flash lamp" is a value indicating the flash power per unit time in a unit volume inside the discharge container of the flash lamp. More specifically, this value is found by dividing the flash power quantity (Q) supplied to the flash lamp by the product of the inner volume (V) of the discharge container and the half-power width ($\Delta t$).

Further, "the half-power width ($\Delta t$)" is a value based on the flash power supplied to the flash lamp and is defined according to clauses (1) or (2) presented hereinbelow according to the specifications of shaping the electric current waveform in the ignition circuit of the flash lamp.

A half-width found by the method relating to clauses (1) or (2) presented hereinbelow from the waveform relating to light with a wavelength of 300 to 500 nm with respect to the flash emitted from the flash lamp can be substituted as the half-power width ($\Delta t$) in Formula (1).

(1) In a transient current circuit composed of a capacitor, a waveform shaping coil, and an electric resistance of a flash lamp, under the conditions with a large damping of electric current, a waveform of a simple attenuation type shown in FIG. 4(*i*) is obtained as the waveform (sometimes referred hereinbelow simply as "flash power waveform") describing the relationship between the flash power supplied to the flash lamp (10) and time. Therefore, the width of the section on a time axis between the two points (point (a) and point (b) in FIG. 4(*i*)) indicating the half values of power quantity in the peak is defined as a half-power width.

Figure 4:
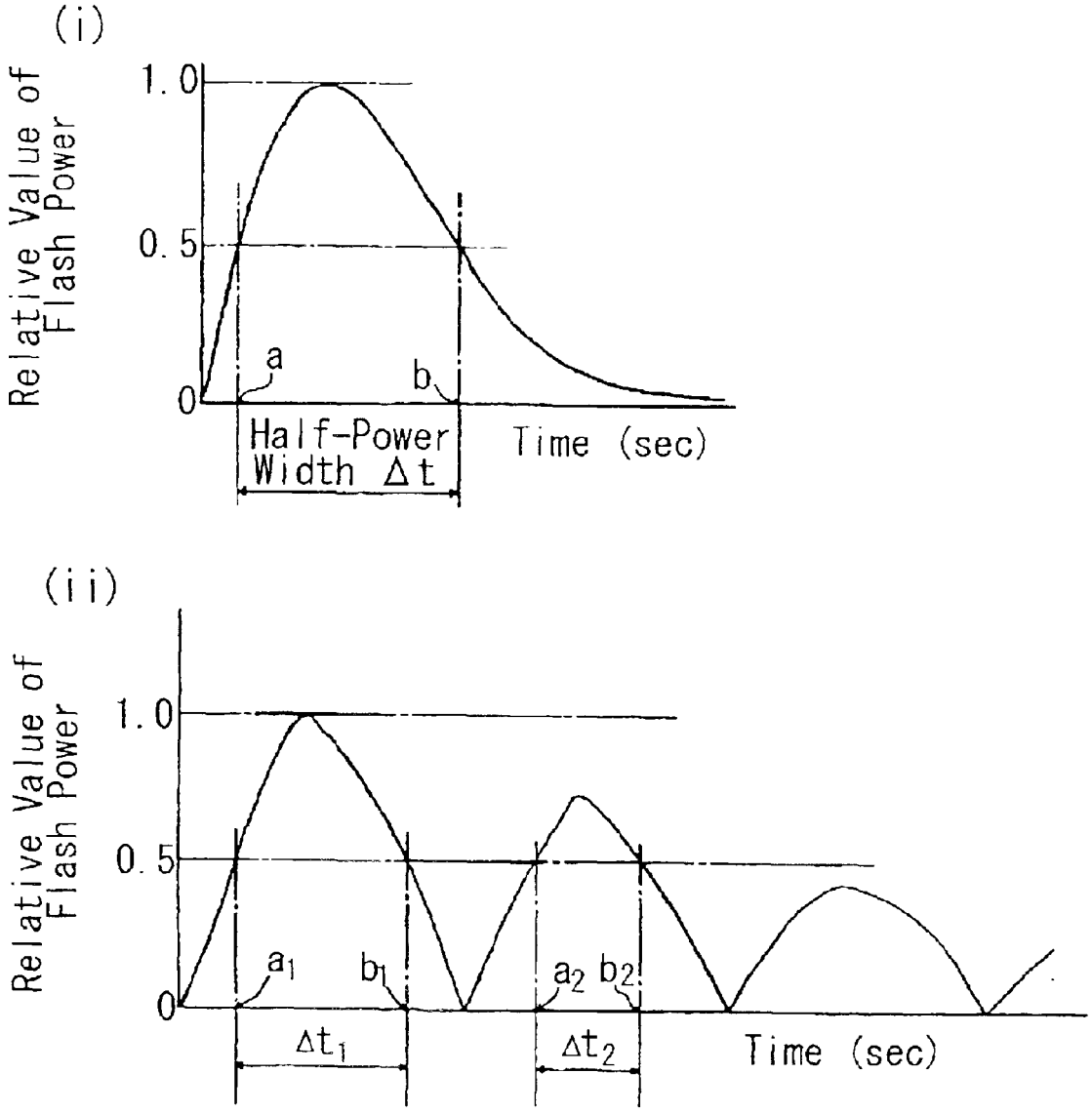
FIG. 4 is an explanatory drawing illustrating the waveform showing the relationship between the flash power supplied to the flash lamp and time.

(2) Under the conditions with a small damping of electric current, a power waveform of an oscillation attenuation type shown in FIG. 4(*ii*) is obtained as the flash power waveform. Therefore, the total sum of time intervals in which the power is no less than the half of the maximum power peak value among a plurality of peaks constituting the waveform is defined as the half-power width for this case.

More specifically, in the waveform shown in FIG. 4(*ii*), the sum of the width $\Delta t_1$ between the points $a_1$ and $b_1$ and the width $\Delta t_2$ between the points $a_2$ and $b_2$ is the half-power width ($\Delta t$).

The half-power width ($\Delta t$) is preferably 0.3 $\mu$sec–10 msec.

If the half-power width ($\Delta t$) is less than 0.3 $\mu$sec, particularly if it is less than 0.1 $\mu$sec, the diameter of plasma generated inside the discharge container by the flash power supplied into the flash lamp is not sufficiently large and there is the probability that good radiant state will not be obtained.

On the other hand, when the half-power width ($\Delta t$) exceeds 10 msec, the flash power quantity required for a single flash ignition becomes extremely high, and such performance is unsuitable for practical use, with the exception of cases with special requirements.

When the average power density is outside the specified range, the intensity of bremsstrahlung relating to electrons produced by ionization of the sealed substance (mercury) cannot be sufficiently increased. Therefore, a high radiant efficiency cannot be obtained.

From the standpoint of reproducibility of emission during ignition, it is preferred that the preheating with preheating means 20 be conducted till the temperature of the outer peripheral surface of the discharge container 11 constituting the flash lamp 10 satisfies the condition specified by the aforesaid Formula (2) immediately prior to flash ignition.

In practice, with consideration for the effect of heat on the structural elements of flash lamp 10, for example, in the flash lamp 10 with the quantity of contained mercury of 5 mg/cm$^3$, the preheating is usually conducted till the temperature of the outer peripheral surface of the discharge container 11 constituting the flash lamp 10 becomes 540 to 600 K.

If the preheating is not conducted till the temperature of the outer peripheral surface of the discharge container is within the specified temperature range, the temperature of the inner peripheral surface of the discharge container is not sufficiently increased. As a result, the flash power is supplied in a state in which mercury sealed inside the discharge container is not entirely evaporated and the vapor pressure of mercury is not sufficiently increased. Therefore, there is the probability that the radiance for each flash ignition will be scattered and that a stable flash radiant characteristic will not be obtained.

Furthermore, in particular, in the cases when a flash lamp unit is driven continuously, the temperature inside the flash lamp increases and the radiance gradually changes as the number of flash ignition cycles increases. Therefore, there is the probability that a stable flash radiant characteristic will not be obtained. Furthermore, there is the probability that mercury will not emit light even when the flash power is supplied, because mercury that has evaporated in the emission region formed in the space between the electrodes inside the discharge container during flash ignition undergoes condensation on the low-temperature zones existing in the non-emission region formed in the space into which the electrode rods are extended inside the discharge container.

With the flash lamp unit of the above-described configuration, mercury, which has a minimum excitation voltage and an ionization voltage lower than those of rare gases, is sealed as the main light-emitting substance inside the discharge container 11 constituting the flash lamp 10. In addition, the quantity of the contained mercury is specifically set such that the electron density increasing due to the mercury ionization becomes sufficiently high in a flash ignition state. Moreover, a flash ignition state of an emission source required by the specified conditions is obtained in the flash lamp 10 preheated with preheating means 20. Therefore, the average power density in the flash lamp 10 and the quantity of contained mercury can be controlled, thereby making it possible to use the bremsstrahlung relating to the electrons produced by ionization of mercury at a high ratio and increasing the emission ratio of long-wave UV radiation and short-wave visible light in the flash emitted by the flash lamp 10. Furthermore, because the minimum excitation voltage of the mercury that has been sealed is small, the intensity of bright lines generated by the excitation of mercury is increased.

Therefore, a high radiant efficiency can be obtained in the flash lamp unit.

Furthermore, the minimum excitation voltage of mercury is about 4.6 eV and the ionization voltage thereof is about 10 eV, those values being less than the values of xenon (minimum excitation voltage about 8 eV and ionization voltage about 12 eV) used as a light-emitting substance in the rare gas flash lamps.

In practice, in the flash lamp units of the above-described configuration, the radiator emitting the flash can be made close to a black body, and the radiant efficiency indicating the radiant quantity of the flash related to the flash power quantity that has been supplied can be easily and reliably, without complications, raised to no less than 40%. Here, the conversion efficiency of the supplied power quantity to the radiant quantity in the black body is 100%.

In the rare gas flash lamps, the radiant efficiency is very difficult to increase without complications to above 40%.

Further, because mercury has been sealed as the main light-emitting substance, the emission ratio of short-wave UV light generated inside the discharge container 11 of flash lamp 10 in the flash ignition state is small. Therefore, rapid degradation of flash lamp 10 occurring due to absorption of short-wave UV light by the discharge container 11 can be prevented.

Therefore, a long service life can be obtained for the flash lamp unit.

Further, because mercury has been sealed as the main light-emitting substance, though the electron density inside the discharge container 11 increases, the current value inside the discharge container 11 relating to the flash ignition state does not increase accordingly. As a result, the degree of freedom in designing the electrodes (anode 14 and cathode 15) is high. Therefore, the shape of the flash lamp unit can be advantageously designed according to application thereof.

Because the preheating is conducted with preheating means 20 so that the temperature of the outer peripheral surface of discharge container 11 becomes within the specified temperature range, when the flash power is supplied, mercury is present in an almost completely evaporated state inside the discharge container 11. Therefore, due to the application of a high trigger voltage, the flash power is supplied reliably, the flash lamp 10 assumes a flash ignition state, and a stable flash radiant characteristic can be obtained.

(Second Preferred Embodiment)

The flash lamp unit of the second embodiment has a configuration identical to that of the first embodiment, except that the quantity of contained mercury, which is the main light-emitting substance, is not specified, an alkali element in a specified quantity is sealed, and the flash lamp has to be ignited under the conditions such that the aforesaid Formula (3), rather than Formula (1), is valid.

Mercury or alkali element to be sealed in the flash lamp may be in the elemental form or as a compound. When a compound is sealed, it is preferred that a compound be selected which has a vapor pressure equal to or higher than that of the elemental substance at the same temperature.

In the flash lamp unit having the above-described configuration, the quantity of contained mercury per unit volume of the discharge container is preferably 0.2 to 55 $mg/cm^3$.

The "alkali element" is one or more types of alkali metals selected from sodium, potassium, rubidium, and cesium.

The quantity of the sealed alkali element in the discharge container, as represented by the ratio, ($\alpha$),of the mole number of the alkali element to mole number of mercury sealed in the discharge container (referred to hereinbelow as "the molar fraction of alkali element") is 0.1 to 20%.

In practice, the quantity of the sealed alkali element per unit volume of the discharge container is 0.03 $\mu g/cm^3$ to 7.3 $mg/cm^3$. In this quantity of sealed alkali element, the lower limit value relates to the case when sodium is used as the alkali element and the upper limit value relates to the case when cesium is used as the alkali element.

When the alkali element is composed of no less than two alkali metals, the mole number of the alkali element in the flash lamp is the sum of mole numbers of all the alkali metals constituting the alkali element.

When the molar fraction of the alkali element is less than 0.1%, a sufficient electron density in the flash lamp in the flash ignition state cannot be obtained. As a result, a radiant efficiency larger than that obtained when mercury alone was sealed cannot be obtained.

On the other hand, when the molar fraction of the alkali element exceeds 20%, the vapor pressure of mercury and the alkali element inside the discharge container decreases and a high radiant efficiency cannot be obtained without loosing he ignition reliability of the flash lamp.

In Formula (3), when the alkali element is composed of no less than two alkali metals, the average value of the atomic weight of the alkali element relating to the ratio S of the atomic weight of cesium to the average value of the atomic weight of the alkali element is the atomic weight obtained by mole-added averaging conducted for all the alkali metals constituting the alkali element.

The "average power density ($W_2$) in the flash lamp" and the "half-power width ($\Delta t$)" are the values defined similarly to the average power density and half-power width in the flash lamp in Formula (1).

When the average power density in the flash lamp is outside the specified range, the intensity of bremsstrahlung relating to electrons produced by ionization of the sealed substance (mercury and the specified alkali substance) cannot be sufficiently increased. Therefore, a high radiant efficiency cannot be obtained.

It is preferred that the preheating with preheating means be conducted till the temperature of the outer peripheral surface of the discharge container constituting the flash lamp satisfies the condition specified by the aforesaid Formula (4).

In practice, with consideration for the effect of heat on the structural elements of flash lamp, for example, in the flash lamp with the quantity of contained mercury of 5 mg/cm$^3$ and the quantity of the sealed alkali element of 0.166 mg/cm$^3$ (molar fraction of the alkali element is 5%), the preheating is usually conducted till the temperature of the outer peripheral surface of the discharge container constituting the flash lamp becomes 700 to 750 K.

If the preheating is not conducted till the temperature of the outer peripheral surface of the discharge container is within the specific temperature range, the temperature of the inner peripheral surface of the discharge container is not sufficiently increased. As a result, the flash power is supplied in a state in which the sealed substance (mercury and the specified alkali substance) sealed inside the discharge container is not entirely evaporated and the vapor pressure of the sealed substance is not sufficiently increased. Therefore, there is the probability that the radiance values for each flash ignition will be scattered and that a stable flash radiant characteristic will not be obtained.

Furthermore, in particular, in the cases when a flash lamp unit is driven continuously, the temperature inside the flash lamp increases and the radiance gradually changes as the number of flash ignition cycles increases. Therefore, there is the probability that a stable flash radiant characteristic will not be obtained. Furthermore, there is the probability that mercury or the alkali element will not emit light even when the flash power is supplied and that an ignition state will be obtained in which the required radiant characteristic will not be demonstrated, because the sealed substance that has evaporated in the emission region formed in the space between the electrodes inside the discharge container during flash ignition undergoes condensation on the low-temperature zones existing in the non-emission region formed in the space into which the electrode rods are extended inside the discharge container.

With the flash lamp unit of the above-described configuration, the operation effect similar to that of the flash lamp unit of the first embodiment can be obtained. Thus, a high radiant efficiency and a long service life can be obtained. However, the flash lamp unit of the second embodiment has a structure such that mercury, which is the main light-emitting substance, and an alkali element are sealed, this alkali element having the minimum excitation voltage and ionization voltage much lower than those of mercury, when the temperature inside the discharge container is comparatively low, the electron density inside the discharge container is created by the electrons relating to the alkali element, and if the average power density ($W_2$) increases, plasma temperature inside the flash lamp rises and mercury ionization starts shortly after the alkali element is almost entirely ionized, whereby setting the flash lamp into the flash ignition state by the specified conditions provides for control of the average power density and the sealed of the quantity alkali element in the flash lamp.

The minimum excitation voltage and ionization voltage of the alkali element is no more than about 5 eV.

Because the preheating is conducted with preheating means till the temperature of the outer peripheral surface of the discharge container reaches the specified temperature range, when the flash power is supplied, the sealed substance (mercury and the specified alkali substance) assumes the vapor state inside the discharge container. As a result, when a high trigger voltage is applied to the flash lamp, the flash power is supplied and the flash ignition state can be attained with good reliability and a stabilized flash radiant characteristic can be obtained.

Sealing the alkali element makes it possible to obtain vapors of the sealed substance with a higher density and to obtain a higher electron density at a low temperature than in the case when mercury alone is sealed in the discharge container. Therefore, a high radiant efficiency can be obtained at a lower flash power.

Such a flash lamp unit can be advantageously used as the light source of flash radiation devices.

Because the flash lamp unit constituting the light source in such flash radiation devices has a high radiant efficiency, in order to obtain a flash with a radiant quantity required for processing the article to be processed, the number of flash lamp units used as the light sources may be actually less than the number of lamps required as the light sources in the flash radiation devices comprising rare gas flash lamps as the light sources. Moreover, it is not necessary to increase the flash power supplied to each flash lamp constituting the flash lamp. Therefore, despite a small size, an excellent flash radiant performance can be obtained, without increasing the cost of the flash radiation device itself. Alternatively, the flash power of the flash lamp unit can be reduced, making possible the size decrease and cost reduction of the power source unit.

The flash radiation devices can be advantageously used for a variety of treatment processes such as annealing employed for instantaneous heating of products, for example, composed of metals, ceramics, glass, plastics, and the like, or in the fabrication of semiconductor devices, as well as for alloy reaction treatment, reflow treatment, photochemical reactions such as curing of photocurable materials and the like, batch treatment of recording media, and the like.

The best mode of implementation of the present invention has been described hereinabove, but a variety of modifications can be introduced in the present invention.

For example, a gas composed of one or no less than two rare gases selected for helium gas, neon gas, argon gas, krypton gas, and xenon gas may be sealed in a quantity such that the pressure thereof at room temperature (not higher than 25° C.) is not higher than $3\times10^5$ Pa.

In this case, the flash lamp can be easily set in a flash ignition state and the temperature of the inner peripheral surface of the discharge container can be uniformly raised to the desired temperature within a short time by preheating with preheating means.

In order to attain such an operation effect with good reliability, it is preferred that the quantity of the sealed rare gas be such that the pressure thereof at room temperature be no less than 1000 Pa. However, if the quantity of the sealed rare gas is too high, a high start-up voltage is required for the flash lamp. Therefore, a high trigger voltage which has to be generated in the trigger circuit increases, thereby decreasing the degree of freedom in designing the trigger circuit.

Furthermore, preheating means may also have a structure in which a heater from a straight wire is wound around the outer peripheral surface of the discharge container constituting the flash lamp. In this case, a flash lamp may be used having a structure in which no trigger electrode is arranged on the outer peripheral surface of the discharge container.

Furthermore, the structure of preheating means is not limited to that in which heating is conducted from the outer peripheral surface of the discharge container. For example, a structure may be used in which the average power for preheating is less than the average power supplied to the flash lamp during flashing, for example, a structure in which the average power for preheating assumes a value of 0.1% the average power during flashing. Such a preheating means has a structure in which the flash lamp itself is preheated with the energy generated by supplying the average power for preheating. In this case, the energy generated by the preheating can be used not only for heating the flash lamp, but also, for example, for preheating the article which is to be treated with the flash radiation device comprising the flash lamp unit. Furthermore, the power source unit for preheating the article can be also used as the power source for supplying electric power for preheating.

The flash lamp structure is not limited to that in which electric power is supplied via electrodes. For example, it may be an electrodeless discharge lamp comprising no electrodes inside the discharge container. In this case, a circuit may be provided which is capable of causing an insulation breakdown inside the discharge container composed of a transparent material and simultaneously supplying the flash power.

Embodiments

Examples of the present invention will be described below, but the present invention is not limited thereto.

EXAMPLE 1

A flash lamp unit (sometimes referred to hereinbelow as a "flash lamp unit (1)") comprising a flash lamp with an ignition circuit in which a power source unit is a discharge container power source and preheating means in which a nichrome wire is wound around a cylindrical heating tube manufactured from quartz glass, the configuration of the unit following that shown in FIG. 1 and the system being shown in FIG. 3.

The flash lamp constituting the flash lamp unit (1) had the following specifications: the inner volume of the discharge container: 10 $cm^3$, the electric capacitance of the main capacitor: 200 $\mu$F, the charge voltage: 1920 V, the half-power width: 0.24 ms. Mercury was sealed inside the discharge container at 3.5 $mg/cm^3$.

Figure 5:
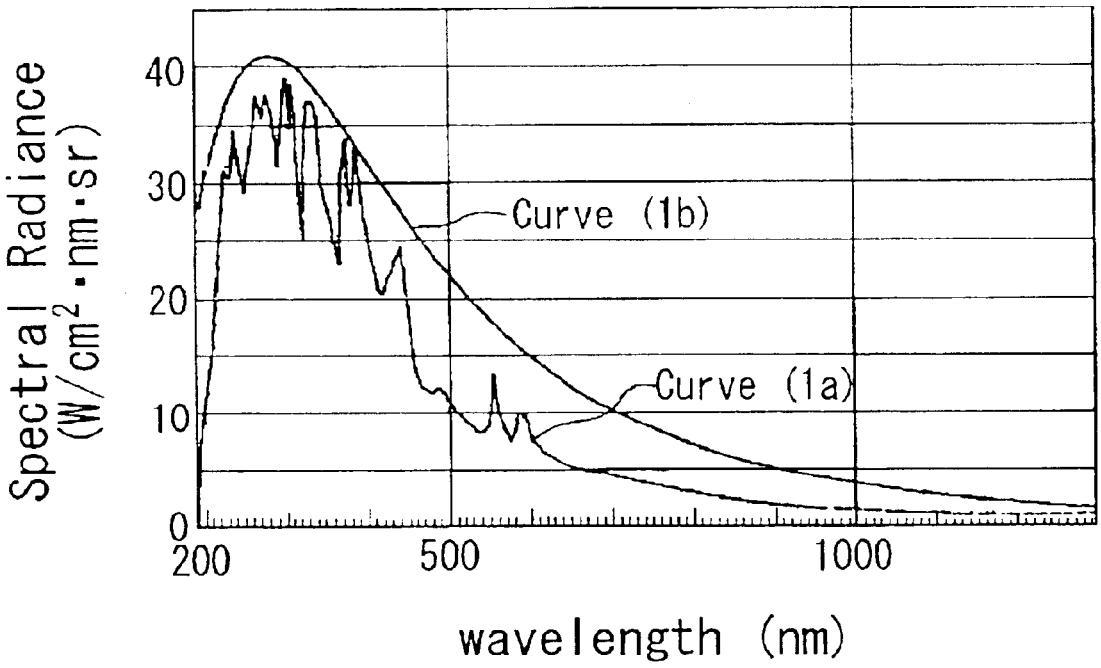
FIG. 5 is an explanatory drawing illustrating an average spectral radiance relating to Embodiment 1.

After the flash lamp unit (1) thus manufactured has been preheated so that the temperature of the outer peripheral surface of the discharge container of the flash lamp reached 700 K, the flash lamp was set to the flash ignition state under conditions such that the average power density assumed the value represented by Formula (a) hereinbelow, and the average spectral radiance of the emitted flash light was measured. The results are shown in FIG. 5.

The average power density relating to Formula (a) hereinbelow satisfies the above-described condition (1).

$$\text{Average power density } (W/cm^3)=1.1\times10^5\times H^{0.25} \quad \text{(a)}$$

[in the formula, H denotes the quantity of contained mercury ($mg/cm^3$)].

In FIG. 5, the curve (1*a*) represents the average spectral radiance relating to the flash lamp unit (1), and the curve (1*b*) represents the spectral radiance relating to a black body having the temperature same as that of plasma generated inside the discharge container in the flash lamp unit (1).

The radiant efficiency was found from the value of the average spectral radiance of flash lamp unit (1) shown in the curve (1*a*) that was divided by the spectral radiance of the black body shown in curve (1*b*). The result was 80%.

EXAMPLE 2

Figure 6:
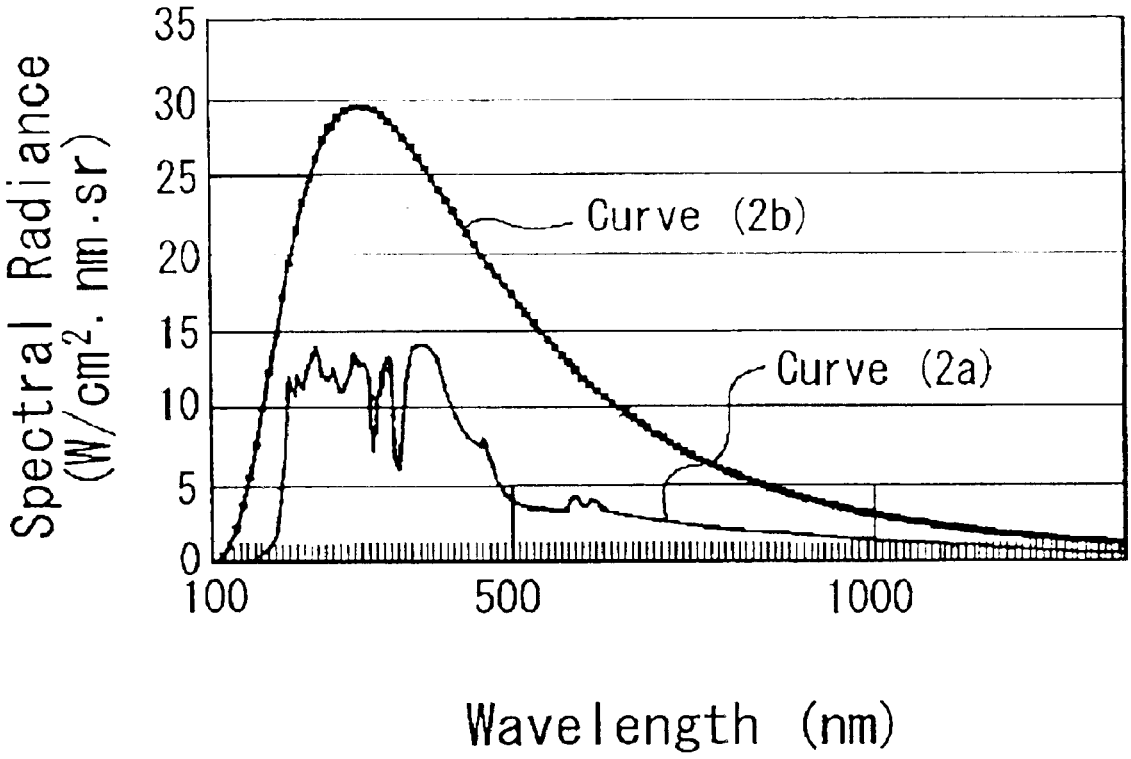
FIG. 6 is an explanatory drawing illustrating an average spectral radiance relating to Embodiment 2.

A flash lamp unit (sometimes referred to hereinbelow as a "flash lamp unit (2)") was manufactured, this unit having the structure identical to that of Example 1, except that it was provided with a flash lamp having the following specifications: the inner volume of the discharge container: 12 $cm^3$, the electric capacitance of the main capacitor: 100 $\mu$F, the charge voltage: 3000 V, the half-power width: 0.2 ms and having mercury sealed inside the discharge container at 55 $mg/cm^3$. After the flash lamp unit (2) thus manufactured has been preheated so that the temperature of the outer peripheral surface of the discharge container of the flash lamp reached 1300 K, the flash lamp was set to the flash ignition state under conditions such that the average power density assumed the value represented by Formula (b) hereinbelow, and the average spectral radiance of the emitted flash light was measured. The results are shown in FIG. 6.

The average power density relating to Formula (b) hereinbelow satisfies the above-described condition (1).

$$\text{Average power density } (W/cm^3)=2.4\times10^4\times H^{0.25} \quad \text{(b)}$$

[in the formula, H denotes the quantity of contained mercury ($mg/cm^3$)].

In FIG. 6, the curve (2*a*) represents the average spectral radiance relating to the flash lamp unit (2), and the curve (2*b*) represents the spectral radiance relating to a black body having the temperature same as that of plasma generated inside the discharge container in the flash lamp unit (2).

The radiant efficiency was found from the value of the average spectral radiance of flash lamp unit (2) shown in the curve (2*a*) that was divided by the spectral radiance of the black body shown in curve (2*b*). The result was 42%.

EXAMPLE 3

Figure 7:
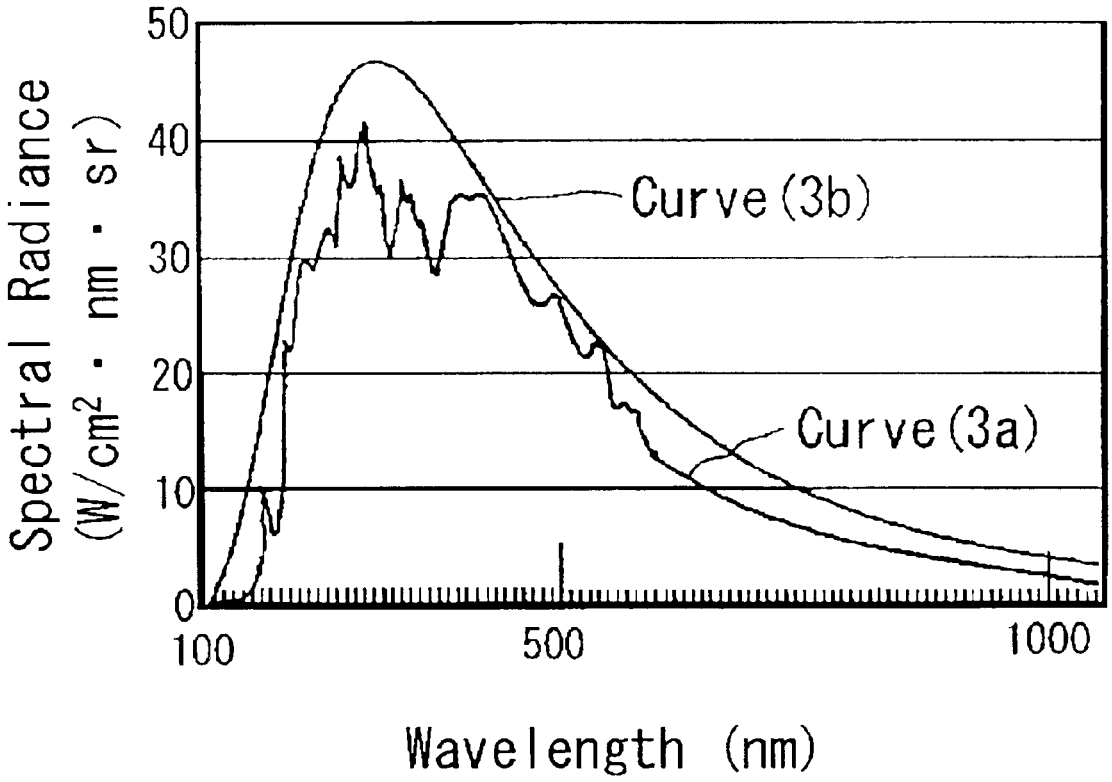
FIG. 7 is an explanatory drawing illustrating an average spectral radiance relating to Embodiment 3.

A flash lamp unit (sometimes referred to hereinbelow as a "flash lamp unit (3)") was manufactured, this unit having the structure identical to that of Example 1, except that it was provided with a flash lamp having the following specifications: the inner volume of the discharge container: 12 $cm^3$, the electric capacitance of the main capacitor: 100 $\mu$F, the charge voltage: 5100 V, the half-power width: 0.2 ms and having mercury sealed inside the discharge container at 55 $mg/cm^3$. After the flash lamp unit (3) thus manufactured has been preheated so that the temperature of the outer peripheral surface of the discharge container of the flash lamp reached 1300 K, the flash lamp was set to the flash ignition state under conditions such that the average power density assumed the value represented by Formula (c) hereinbelow, and the average spectral radiance of the emitted flash light was measured. The results are shown in FIG. 7.

The average power density relating to Formula (c) hereinbelow satisfies the above-described condition (1).

$$\text{Average power density } (W/cm^3)=7.0\times10^4\times H^{0.25} \quad \text{(b)}$$

[in the formula, H denotes the quantity of contained mercury ($mg/cm^3$)].

In FIG. 7, the curve (3*a*) represents the average spectral radiance relating to the flash lamp unit (3), and the curve (3*b*) represents the spectral radiance relating to a black body having the temperature same as that of plasma generated inside the discharge container in the flash lamp unit (3).

The radiant efficiency was found from the value of the average spectral radiance of flash lamp unit (3) shown in the curve (3*a*) that was divided by the spectral radiance of the black body shown in curve (3*b*). The result was 89%.

Comparative Example 1

Figure 8:
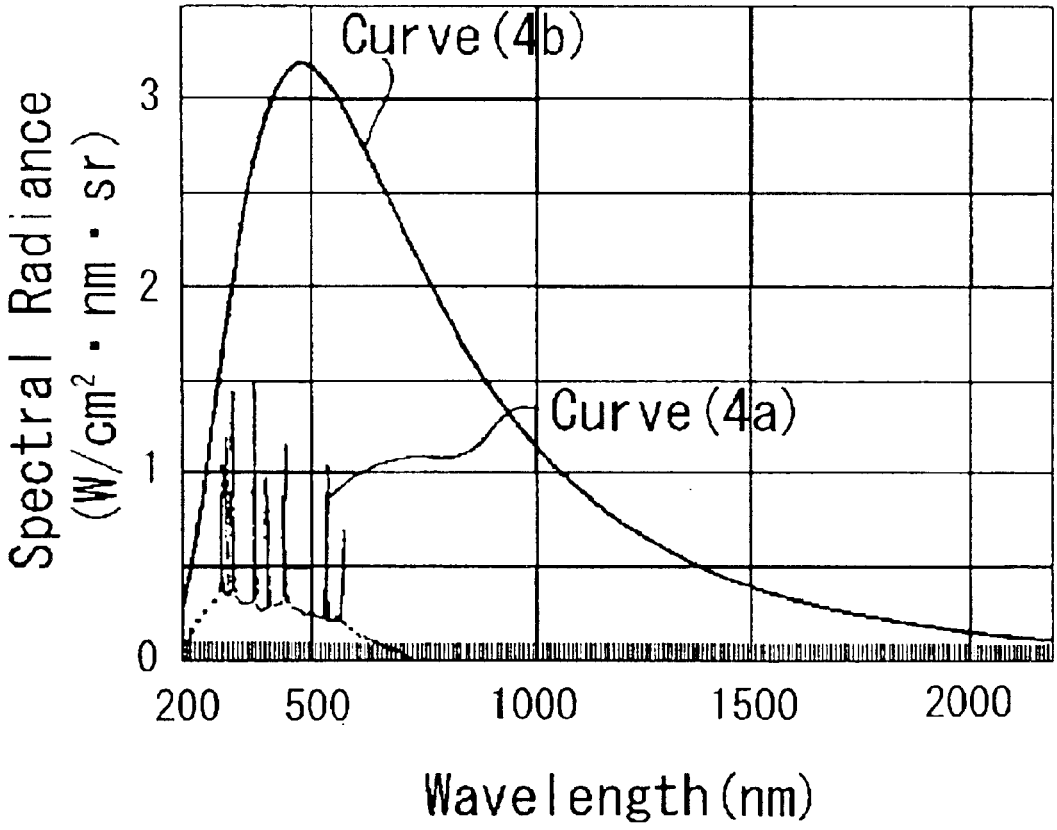
FIG. 8 is an explanatory drawing illustrating an average spectral radiance relating to Comparative Example 1.

A flash lamp unit (sometimes referred to hereinbelow as a "comparative flash lamp unit (1)") was manufactured, this unit having the structure identical to that of Example 1, except that it was provided with a flash lamp having the following specifications: the inner volume of the discharge container: 12 $cm^3$, the electric capacitance of the main capacitor: 50 $\mu$F, the charge voltage: 850 V, the half-power width: 0.38 ms and having mercury sealed inside the discharge container at 4.1 $mg/cm^3$. After the comparative flash lamp unit (1) thus manufactured has been preheated so that the temperature of the outer peripheral surface of the discharge container of the flash lamp reached 680 K, the flash lamp was set to the flash ignition state under conditions such that the average power density assumed the value represented by Formula (d) hereinbelow, and the average spectral radiance of the emitted flash light was measured. The results are shown in FIG. 8.

The average power density relating to Formula (d) hereinbelow satisfies the above-described condition (1).

$$\text{Average power density } (W/cm^3)=0.7\times10^3\times H^{0.25} \quad \text{(d)}$$

[in the formula, H denotes the quantity of contained mercury ($mg/cm^3$)].

In FIG. 8, the curve (4*a*) represents the average spectral radiance relating to the comparative flash lamp unit (1), and the curve (4*b*) represents the spectral radiance relating to a black body having the temperature same as that of plasma generated inside the discharge container in the comparative flash lamp unit (1).

The radiant efficiency was found from the value of the average spectral radiance of comparative flash lamp unit (1) shown in the curve (4*a*) that was divided by the spectral radiance of the black body shown in curve (4*b*). The result was 8%.

Comparative Example 2

Figure 9:
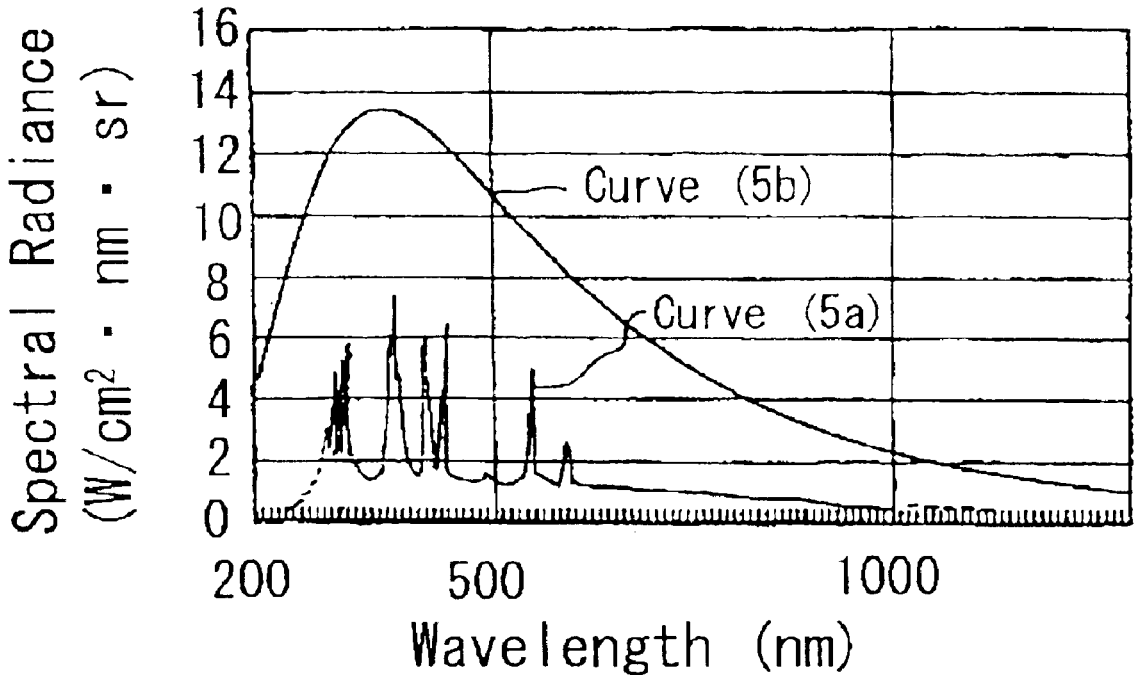
FIG. 9 is an explanatory drawing illustrating an average spectral radiance relating to Comparative Example 2.

A flash lamp unit (sometimes referred to hereinbelow as a "comparative flash lamp unit (2)") was manufactured, this unit having the structure identical to that of Example 1, except that it was provided with a flash lamp having the following specifications: the inner volume of the discharge container: 12 $cm^3$, the electric capacitance of the main capacitor: 50 $\mu$F, the charge voltage: 1050 V, the half-power width: 0.38 ms and having mercury sealed inside the discharge container at 4.3 $mg/cm^3$. After the comparative flash lamp unit (2) thus manufactured has been preheated so that the temperature of the outer peripheral surface of the discharge container of the flash lamp reached 700 K, the flash lamp was set to the flash ignition state under conditions such that the average power density assumed the value represented by Formula (e) hereinbelow, and the average spectral radiance of the emitted flash light was measured. The results are shown in FIG. 9.

The average power density relating to Formula (e) hereinbelow satisfies the above-described condition (1).

$$\text{Average power density } (W/cm^3)=4.2\times10^3\times H^{0.25} \quad \text{(e)}$$

[in the formula, H denotes the quantity of contained mercury ($mg/cm^3$)].

In FIG. 9, the curve (5*a*) represents the average spectral radiance relating to the comparative flash lamp unit (2), and the curve (5*b*) represents the spectral radiance relating to a black body having the temperature same as that of plasma generated inside the discharge container in the comparative flash lamp unit (2).

The radiant efficiency was found from the value of the average spectral radiance of comparative flash lamp unit (2) shown in the curve (5*a*) that was divided by the spectral radiance of the black body shown in curve (5*b*). The result was 20%.

The results presented above confirmed that in the flash lamp unit according to Comparative Example 1 and Comparative Example 2, because the average power density of the flash lamp constituting the flash lamp unit was too small and flash ignition was conducted in a state in which the specified conditions were not satisfied, a high radiant efficiency could not be obtained, whereas in the flash lamp unit according to Examples 1 through 3, the specified quantity of the sealed substance was sealed and flash ignition was conducted in a state in which the average power density in the flash lamp constituting the flash lamp unit satisfied the specified conditions, thereby making it possible to obtain a high radiant efficiency.

EXAMPLE 4

Figure 10:
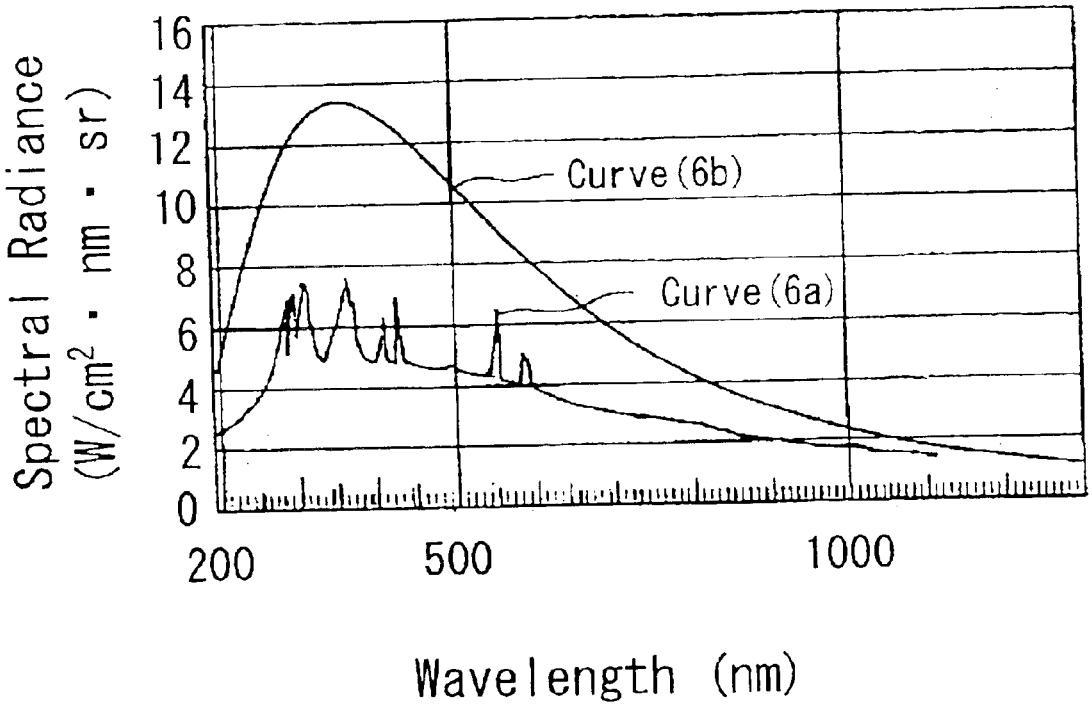
FIG. 10 is an explanatory drawing illustrating an average spectral radiance relating to Embodiment 4.

A flash lamp unit (sometimes referred to hereinbelow as a "flash lamp unit (4)") was manufactured, this unit having the structure identical to that of Example 1, except that it was provided with a flash lamp having the following specifications: the inner volume of the discharge container: 12 $cm^3$, the electric capacitance of the main capacitor: 100 $\mu$F, the charge voltage: 2300 V, the half-power width: 0.54 ms and having mercury and cesium as an alkali element sealed inside the discharge container at 3.0 $mg/cm^3$ and 0.2 $mg/cm^3$, respectively (the molar fraction $\alpha$ of the alkali element was 10%). After the flash lamp unit (4) thus manufactured has been preheated so that the temperature of the outer peripheral surface of the discharge container of the flash lamp reached 1050 K, the flash lamp was set to the flash ignition state under conditions such that the average power density assumed the value represented by Formula (f) hereinbelow, and the average spectral radiance of the emitted flash light was measured. The results are shown in FIG. 10.

The average power density relating to Formula (f) hereinbelow satisfies the above-described condition (3). Because cesium alone was filled as the alkali element, the ratio of the atomic weight of cesium to the average value of the atomic weight of the alkali elements was 1.

$$\text{Average power density } (W/cm^3)=8.2\times10^4\times(\alpha/100)^{0.25} \quad \text{(f)}$$

[in the formula, $\alpha$ denotes the ratio of the mole number of the alkali element to the mole number of mercury, (%)].

In FIG. 10, the curve (6*a*) represents the average spectral radiance relating to the flash lamp unit (4), and the curve (6*b*) represents the spectral radiance relating to a black body having the temperature same as that of plasma generated inside the discharge container in the flash lamp unit (4).

The radiant efficiency was found from the value of the average spectral radiance of flash lamp unit (4) shown in the curve (6*a*) that was divided by the spectral radiance of the black body shown in curve (6*b*). The result was 50%.

The results presented above confirmed that in the flash lamp unit according to Example 4, the specified quantity of the sealed substance was sealed and flash ignition was conducted in a state in which the average power density in the flash lamp constituting the flash lamp unit satisfied the specified conditions, thereby making it possible to obtain a high radiant efficiency.

Similar tests were conducted by varying the average power density. The results obtained confirmed that a high radiant efficiency could be obtained when the average power density was no less than the value represented by the following Formula (g).

$$\text{Average power density } (W/cm^3)=5.3\times10^3\times(\alpha/100)^{0.25} \quad \text{(g)}$$

Further, the flash lamp units of Examples 1 through 4 were driven in a continuous mode. Because in the flash lamp unit according to Examples 1 through 3 preheating was conducted till the condition represented by the aforesaid Formula (2) was satisfied and in the flash lamp unit according to Embodiment 4 preheating was conducted till the condition represented by the aforesaid Formula (4) was satisfied, supplying flash power and applying a high trigger voltage made it possible to set the flash lamp units reliably in a flash ignition state and to obtain a stabilized slash radiation characteristic.

Furthermore, the lamps constituting the flash lamp units of Embodiments 1 through 4 were visually checked after they have been driven in a continuous mode. No degradation was observed and the possibility to obtain a long service life was confirmed.

With the flash lamp unit in accordance with the present invention, controlling the average power density and the quantity of the specified sealed substance sealed in the flash lamp makes it possible to use at a high ratio-the bremsstrahlung relating to the electrons derived from ionization of the sealed substance, thereby increasing the radiant ratio of long-wave UV light (light with a wavelength of 200 to 400 nm) or short-wave visible light (light with a wavelength of 400 to 600 nm) in the flash light emitted from the flash lamp. Moreover, because mercury is used as the main light-emitting substance, the emission ratio of short-wave UV light generated in the discharge container of the flash light in a flash ignition state is small. As a result, rapid degradation of flash lamps caused by the discharge container absorbing the short-wave UV radiation can be prevented.

Therefore, a high radiant efficiency and a long service life can be obtained in the flash lamp unit in accordance with the present invention.

The flash radiation device in accordance with the present invention uses the above-described flash lamp unit as a light source. Because the flash lamp unit has a high radiant efficiency, excellent flash radiation performance can be obtained even with a small-size unit.

What is claimed is:

1. A flash lamp unit comprising a flash lamp having mercury sealed in a discharge container, wherein preheating means is provided for preheating said flash lamp; and the quantity of contained mercury in said flash lamp is in the range of 0.2 to 55 $mg/cm^3$, and said flash lamp is ignited under the conditions satisfying the Formula (1) presented below:

$$W_1=Q/(V\times\Delta t)\geqq2.1\times10^4\times H^{0.25} \quad (1)$$

where $W_1$ is the average power density ($W/cm^3$) in the flash lamp, Q is the flash power quantity (J), V is the internal volume ($cm^3$) of the discharge container, $\Delta t$ is the half-power width (sec), and H is the quantity ($mg/cm^3$) of contained mercury.

2. The flash lamp unit according to claim 1, wherein the preheating with preheating means is conducted till the conditions are reached satisfying the Formula (2) presented below:

$$TW_1\geqq5300/\{11.47-\ln(H)\} \quad (2)$$

where $Tw_1$ (K) is the temperature of the outer peripheral surface of the discharge container constituting the flash lamp.

3. The flash lamp unit according to claim 1, wherein the preheating with preheating means is conducted by heating the discharge container constituting the flash lamp from the outer peripheral surface of said discharge container.

4. The flash lamp unit according to claim 1, wherein the preheating with preheating means is conducted by supplying to the flash lamp the average power for preheating having a value less than the average power during flashing.

5. The flash lamp unit according to claim 1, wherein a rare gas composed of at least one of helium gas, neon gas, argon gas, krypton gas, and xenon gas is sealed inside the discharge container constituting the flash lamp in an amount such that the gas has a pressure of no more than $3\times10^6$ Pa at room temperature.

6. A flash radiation device comprising the flash lamp unit defined in claim 1 as a light source.

7. A flash lamp unit comprising a flash lamp having mercury sealed in a discharge container, wherein preheating means is provided for preheating said flash lamp;

an alkali element comprising at least one of sodium, potassium, rubidium, and cesium is sealed inside the discharge container of said flash lamp in an amount such that the ratio of the mole number of said alkali element to the mole number of mercury is in the range of 0.1 to 20%; and said flash lamp is ignited under the conditions satisfying the Formula (3) presented below:

$$W_2=Q/(V\times\Delta t)\geqq5\times10^3\times(\alpha/100\times S)^{0.25} \quad (3)$$

where $W_2$ is the average power density ($W/cm^3$) in the flash lamp, Q is the flash power quantity (J), V is the internal volume ($cm^3$) of the discharge container, $\Delta t$ is the half-power width (sec), $\alpha$ is the ratio (%) of the mole number of the alkali element to the mole number of mercury, and S is the ratio of the atomic weight of cesium to the average value of the atomic weight of alkali elements.

8. The flash lamp unit according to claim 7, wherein the preheating with preheating means is conducted till the conditions are reached satisfying the Formula (4) presented below:

$$Tw_2\geqq(6940\times S^{0.208})/\{8.73\times S^{0.0755-ln(S\times A)}\times(1-\alpha/100)^{0.5}\} \quad (4)$$

where $Tw_2$ (K) is the temperature of the outer peripheral surface of the discharge container constituting the flash lamp and A ($mg/cm^3$) is the quantity of the sealed alkali element.

* * * * *